US005153573A

United States Patent [19]

Spletter

[11] Patent Number: 5,153,573

[45] Date of Patent: Oct. 6, 1992

[54] VIDEO DISPLAY CONTROL SYSTEM FOR LIQUID CRYSTAL DISPLAY OR THE LIKE

[75] Inventor: Gary J. Spletter, Winthrop, Mass.

[73] Assignee: FPD Technology, Inc., Sudbury, Mass.

[21] Appl. No.: 513,253

[22] Filed: Apr. 23, 1990

[51] Int. Cl.[5] ..... G09G 3/34

[52] U.S. Cl. ..... 340/783; 340/784; 340/811; 365/91

[58] Field of Search ..... 340/784, 811, 813, 783, 340/763, 764; 365/91, 92

[56] References Cited

U.S. PATENT DOCUMENTS

| | | | |
|---|---|---|---|
| 3,371,216 | 2/1968 | Sherlock | 365/91 |
| 3,382,372 | 5/1968 | Hutchins et al. | 307/88 |
| 3,415,991 | 12/1968 | Asars | 250/83 |
| 4,192,013 | 3/1980 | Keats et al. | 365/91 |
| 4,779,082 | 10/1988 | Salam | 340/783 |
| 4,903,343 | 2/1990 | Cope et al. | 365/91 |

FOREIGN PATENT DOCUMENTS

| | | | |
|---|---|---|---|
| 634339 | 1/1962 | Canada | 365/91 |
| 2497044 | 6/1982 | France . | |
| 919235 | 2/1963 | United Kingdom | 365/91 |

*Primary Examiner*—Alvin E. Oberley
*Assistant Examiner*—Jick Chin

[57] ABSTRACT

A video display system including an energizable video display control element, a power source for generating power and a control portion. The control portion, in turn, comprises a laddic-shaped addressing element, an input wire, and enabling wire and an input addressing wire. The laddic-shaped addressing element has a pair of sidebars and plurality of rungs including an input rung, at least one addressing rung, and an enabling rung, with the sidebars having a lower magnetic reluctance than the rungs. The input wire is magnetically coupled to the input rung for generating an input flux signal in the addressing element, with the input flux signal having a direction representative of the energization state of the video display control element. The enabling wire is magnetically coupled to the enabling rung, the power source and the video display control element for controlling the transfer of power from the power source to the video display control element to control energization of the video display control element. Finally, the input addressing wire magnetically coupled to the addressing rung for selectively controlling coupling of the input flux signal at the input rung to the enabling rung for controlling coupling by the enabling wire.

13 Claims, 3 Drawing Sheets

VIDEO DISPLAY CONTROL SYSTEM FOR LIQUID CRYSTAL DISPLAY OR THE LIKE

FIELD OF THE INVENTION

The invention relates generally to the field of video display systems for, for example, computers, television or the like, and more particularly relates to control systems for controlling activation and deactivation of individually-controllable picture element control devices used in such displays.

BACKGROUND OF THE INVENTION

A number of diverse types of video display systems have been developed for use with, for example, television receivers, and as video output devices for computer systems and in systems for monitoring and controlling processes in factories. Many video display systems make use of cathode ray tubes, in which a beam of electrons is directed to a display screen to energize phosphors deposited thereon. The phosphors, when energized, emit light of predetermined colors. The electron beam is scanned line-by-line in a raster format across the screen, selectively energizing the phosphors in a pattern defining the image. The intensity of the electron beam is varied, which, in turn, varies the intensity with which the scanned phosphors are energized, to thereby create an image on the screen.

Cathode ray tube video display systems require a significant amount of power to generate and control the electron beam, and they generate quite a bit of heat. In addition, the geometry of the arrangements in the cathode ray tubes that generates the beam normally places a limit on the height and width of the screen that can be accommodated, in relation to the depth of the video display system. More recently, liquid crystal displays have been developed which require substantially less power, and so are often used in, for example, portable battery-operated computers, where power conservation is important. In a liquid crystal display, the image is developed, not directly by generating light having a particular pattern, but instead by creating shadows across a uniform light source, with the shadows defining the pattern required for the image. The shadows are created by devices known as "liquid crystals", whose capability of transmitting light varies with an applied electrical charge. A liquid crystal display system includes a large number of such liquid crystals in a rectangular array, with one liquid crystal being present for each picture element, or "pixel", on the screen. Each liquid crystal is controlled individually, which often results in a complex control circuitry. In addition, the liquid crystal display does not require any arrangement such as is required to generate the beam in a cathode ray tube, and so they can be much thinner, and be able to use less power. As a result, liquid crystal display systems are limited to very small screens.

SUMMARY OF THE INVENTION

The invention provides new and improved arrangement for controlling a video display system which includes, for example, an array of individually-controllable picture element modules, such as a liquid crystal arrangement, for controlling generation of an image.

In brief summary, the invention provides a new video display element that includes an electrically-chargeable video display control element, a power source, and a control portion. The video display element controls the display of a portion of an image. The element has a plurality of display conditions each associated with a charge condition. The power source generates electrical current. The control portion controls the coupling of current from the power source to the video display control element. The control portion includes a laddic-shaped addressing element, an input wire, an enabling wire and an input addressing wire. The laddic-shaped addressing element has a pair of sidebars and plurality of rungs including an input rung, at least one addressing rung, and an enabling rung, with the sidebars having a lower magnetic reluctance than the rungs. The input wire is magnetically coupled to the input rung for generating an input flux signal in the addressing element, with the input flux signal having a direction associated with the charge condition of the video display control element. The enabling wire is magnetically coupled to the enabling rung, the power source and the video display control element for controlling the transfer of current from the power source to the video display control element to control the charge condition of the video display control element. Finally, the input addressing wire is magnetically coupled to the addressing rung for selectively controlling coupling of the input flux signal at the input rung to the enabling rung for controlling coupling of current from the power source by the enabling wire.

In another aspect, the invention provides a video display element comprising an electrically-chargeable video display control element, a power source, and an addressing portion. The video display element controls the display of a portion of an image. The element has a plurality of display conditions each associated with a charge condition. The power source generates electrical current. The control portion controls the coupling of current from the power source to the video display control element. The addressing portion comprises a magnetic input addressing element for receiving at an input magnetic flux representing a selected charge condition for the video display control element and selectively couples the flux to an output to control application of the current generated by the power source to control the charge condition of the video display control element.

In yet another aspect, the invention provides a new video display element that includes a plurality of electrically-chargeable video display control elements, a power source, and a plurality of control portions. Each element controls the display of a portion of an image, and has a plurality of display conditions each associated with a charge condition. The power source generates electrical current. Each control portion controls the coupling of current from the power source to an associated video display control element to thereby control its display condition. Each control portion includes a laddic-shaped addressing element, an input wire, an enabling wire and an input addressing wire. The laddic-shaped addressing element has a pair of sidebars and plurality of rungs including an input rung, at least one addressing rung, and an enabling rung, with the sidebars having a lower magnetic reluctance than the rungs. The input wire is magnetically coupled to the input rung for generating an input flux signal in the addressing element, with the input flux signal having a direction associated with the charge condition of the video display control element. The enabling wire is magnetically coupled to the enabling rung, the power source and the associated video display control element for controlling the transfer of current from the power source to the associated video display control element to control the charge condition of the associated video display control element. Finally, the input addressing wire is magnetically coupled to the addressing rung for selectively controlling coupling of the input flux signal at the input rung to the enabling rung for controlling coupling of current from the power source by the enabling wire.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

DETAILED DESCRIPTION OF AN ILLUSTRATIVE EMBODIMENT

Figure 1:
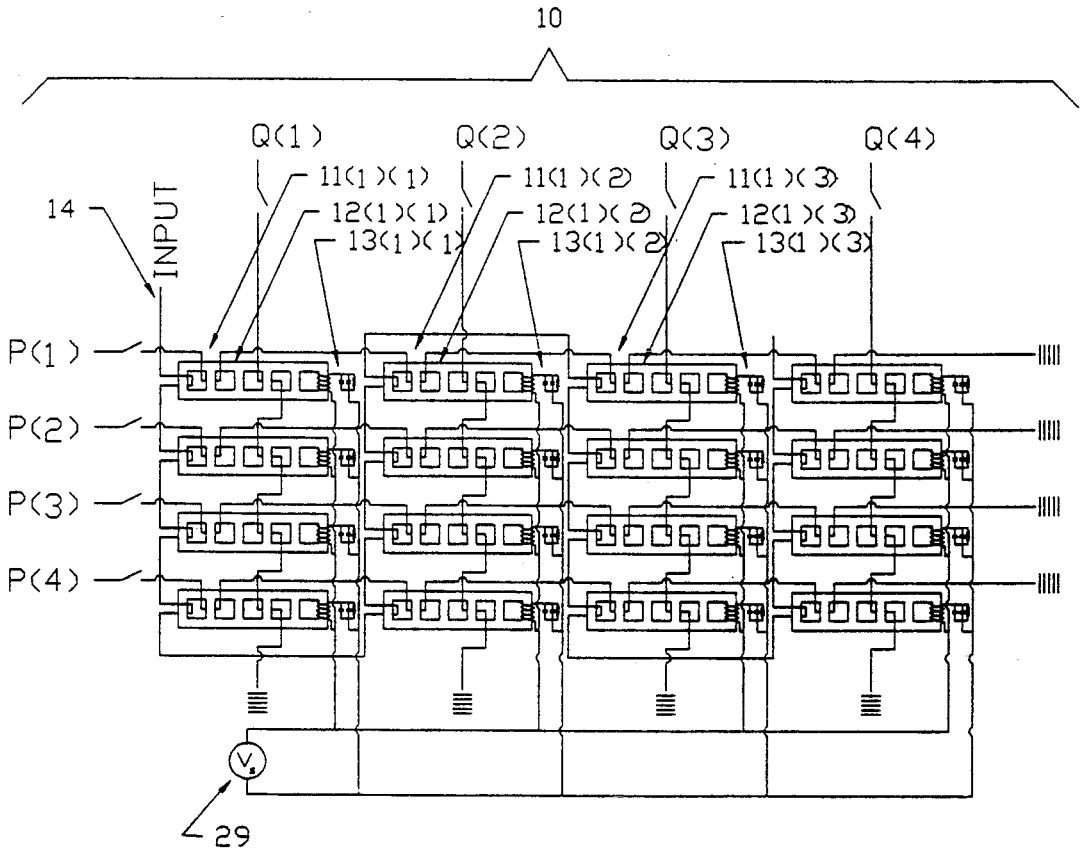
FIG. 1 is a general schematic diagram of a video system control arrangement constructed in accordance with the invention.

FIG. 1 is a general schematic diagram of a video system control arrangement 10 in accordance with the invention. With reference to FIG. 1, the arrangement 10 includes a plurality of control modules, generally identified by reference numeral 11(*i*)(*j*). The modules 11(*i*)(*j*) are electrically arranged in a two-dimensional array comprising a plurality of rows and columns, with the index "i" identifying the row, and index "j" identifying the column, of the module. Each control module 11(*i*)(*j*) includes an addressing element 12(*i*)(*j*) and an energizable video element 13(*i*)(*j*), such as a liquid crystal, for controlling a picture element on a screen (not shown). The video elements 13(*i*)(*j*) may be physically arranged in a rectangular array across a uniform light source (not shown) to regulate, under control of the corresponding addressing elements 12(*i*)(*j*), transmission of light to an operator (also not shown) to form an image.

The control modules 11(*i*)(*j*) are all connected to a power source 29 that is used to selectively energize the video elements 13(*i*)(*j*) under control of the addressing elements 12(*i*)(*j*). The power source 29 generates a pulsed sinusoidal signal of a selected frequency. As described below, each addressing element 12(*i*)(*j*), in combination with the video element 13(*i*)(*j*) connected thereto, forms a resonant circuit that has a resonant frequency determined, in part, by the condition of the addressing element 12(*i*)(*j*). If the video element 13(*i*)(*j*) is to be energized, the addressing element establishes the resonant frequency at the frequency of the signal provided by the power source 29, to facilitate the flow of current therefrom to charge the video element 13(*i*)(*j*) thereby to energize it.

Typically, if a video element 13(*i*)(*j*), such as a liquid crystal, is not periodically re-charged, its charge dissipates through leakage and the like, enabling it to return to its non-energized state. In that case discharge of the video element 13(*i*)(*j*) is not required. However, it will be appreciated that, if the video element 13(*i*)(*j*) does not so discharge, the addressing element may establish a second resonant frequency, as described below, at a second frequency provided by the power source 29, and the power source 29 may provide a signal having the proper frequency and direction to facilitate the flow of current from the video element 13(*i*)(*j*) thereby to discharge the video element The addressing elements 12(*i*)(*j*) are connected to selected ones of row addressing wires P(i) and column addressing wires Q(j). The row and column addressing wires P(i) and Q(j) are controlled by addressing circuitry (not shown). Each row addressing wire P(i) is connected to all of the addressing elements 12(*i*)(*j*) along a particular row "i", and each column addressing wire Q(j) is connected to all of the addressing element 12(*i*)(*j*) along a particular column "j". Otherwise stated, each addressing element 12(*i*)(*j*) is connected to one row addressing wire P(i) and one column addressing wire Q(j). The row and column addressing wires P(i) and Q(j) carry addressing signals that are used to identify, and permit energization of, particular ones of the addressing element 12(*i*)(*j*) to, in turn, facilitate energization of their associated video elements 13(*i*)(*j*). All of the addressing elements 12(*i*)(*j*) are also all connected in parallel to an input wire 14 which carries an INPUT signal, which can be either asserted or negated.

Generally, to energize a particular video element 13(*i*)(*j*), the addressing element 12(*i*)(*j*) is identified by assertion of the corresponding address signals on the row and column address lines P(i) and Q(j) and, contemporaneously, assertion of the INPUT signal. The power source 29 can thereafter energize the video element 13(*i*)(*j*). Contrariwise, to de-energize the video element 13(*i*)(*j*), the addressing element 12(*i*)(*j*) is identified by assertion of the corresponding address signals P(i) and Q(j) and, contemporaneously, the INPUT signal is negated. The power source 29 can thereafter de-energize the video element 13(*i*)(*j*). These operations, which will be described in greater detail below in connection with FIGS. 2 and 3, can be repeated for each of the video elements 13(*i*)(*j*) in the array. Alternatively, a number of the operations can be performed in parallel or in a pipelined or overlapped manner, as will be described below, which can reduce the time required to modify the image produced by the screen.

Figure 2:
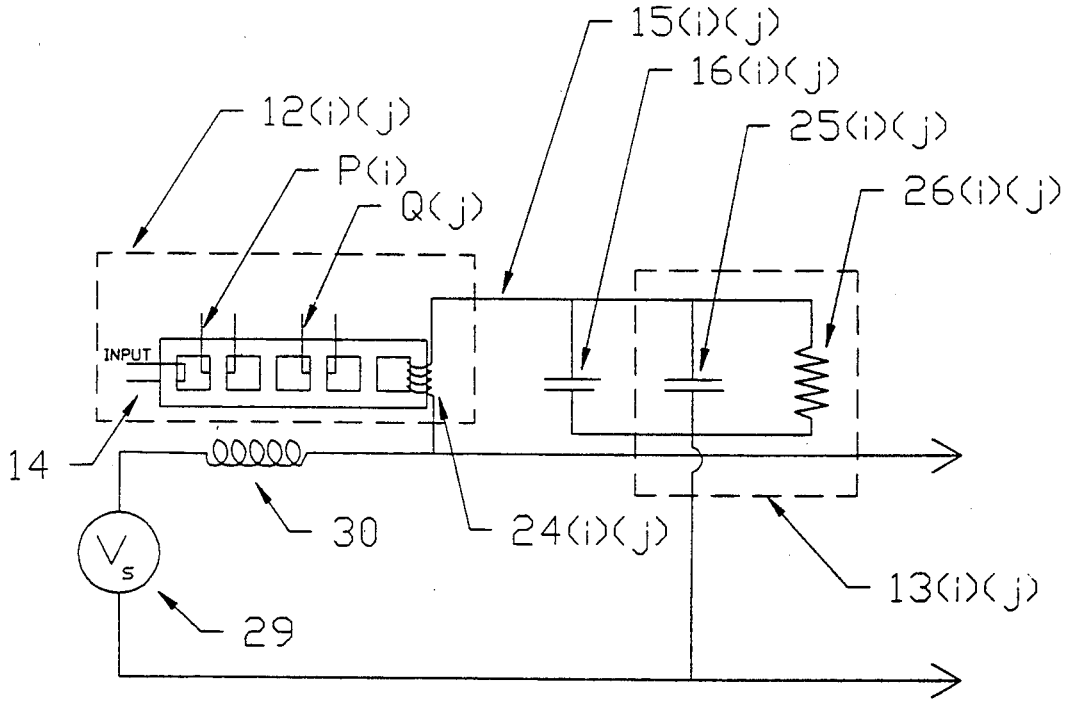
FIG. 2 is a diagram of a portion of the video system control arrangement depicted in FIG. 1, that is useful in understanding a portion of its operation.
Figure 3:
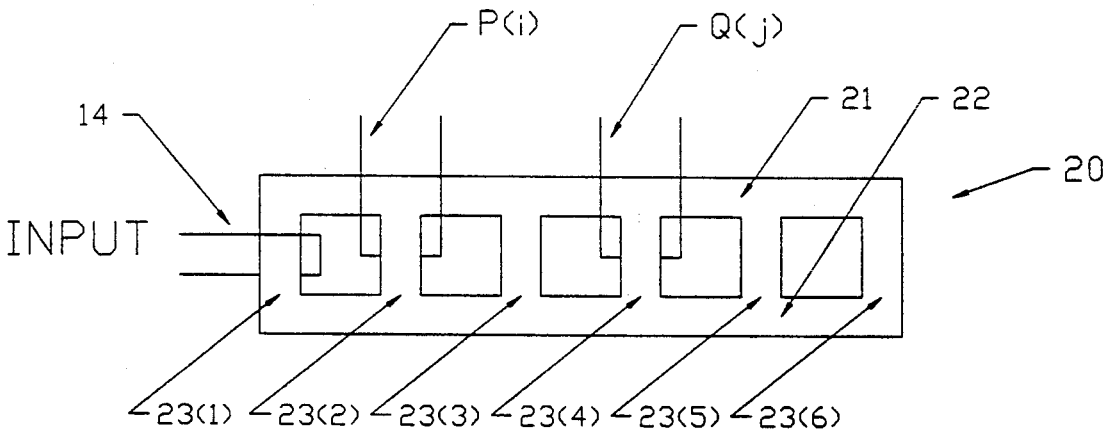
FIG. 3 is another diagram of a portion of the video system control arrangement depicted in FIG. 1, that is useful in understanding other portions of its operation.

The operation of one of the control modules 11(*i*)(*j*) will be described in connection with FIGS. 2 and 3. With reference, initially, to FIG. 2, a control module 11(*i*)(*j*) includes a video element 13(*i*)(*j*) and an addressing element 12(*i*)(*j*) interconnected by a wire 15(*i*)(*j*) and an input capacitor 16(*i*)(*j*). As better shown in FIG. 3, the addressing element 12(*i*)(*j*), in turn, includes a laddic structure 20, which is a ladder-shaped element having two side elements 21 and 22 and a plurality of rungs, generally identified by reference numeral 23(*k*), extending therebetween. The addressing element 12(*i*)(*j*) depicted in FIGS. 2 and 3 includes six rungs 23(*k*), each identified by index "1" through "6" in FIG. 1. All of the side elements 21 and 22 and the rungs 23(K) are preferably formed from a magnetic material such as Permalloy. The addressing element 12(*i*)(*j*) further is connected to a row addressing wire P(i) and a column addressing wire Q(j) which are wound around respective rungs 23(2) and 23(4) of the laddic structure 20. The addressing element 12(*i*)(*j*) is connected to two addressing wires P(i) and Q(j), and has six rungs 23(*k*) to accommodate that number of addressing wires, which are sufficient to display a two-dimensional image, but it will be recognized that the number of addressing wires and associated rungs may be varied as required. If, for example, the video control arrangement 10 is to be used in a three-dimensional video system, a third addressing wire may be required to address the control modules 11(*i*)(*j*), and the number of rungs 23(*k*) may be increased to accommodate the increased number of addressing wires required therefor.

The energization state of the video element 13(*i*)(*j*) is controlled by the INPUT signal, in particular the direction of current comprising the signal, on input line 14. With the row and column addressing wires P(i) and Q(j) wound around the rungs identified by numerals 23(2) and 23(4), respectively, as depicted in FIG. 3, if addressing signals are applied to the wires P(i) and Q(j) with current in a counterclockwise direction, magnetic flux will be generated in the rungs 23(2) and 23(4) in a downward direction and rungs 23(1), 23(3) and 23(5) in in upward direction As a result, a complete magnetic circuit is generated resulting from the current in addressing wire P(i) in adjacent rungs 23(2) and 23(3) and the portion of sidewalls 21 and 22 therebetween, and a second complete magnetic circuit is generated resulting from the current in addressing wire Q in adjacent rungs 23(4) and 23(5) and the portion of sidewalls 21 and 22 therebetween. The level of current, and the dimensions and materials of the rungs 23(*k*) and side elements are selected so the flux generated in the rungs 23(2) through 23(5) and side elements substantially saturate those rungs 23(2) through 23(5) of the laddic structure 20, but not the rungs 23(1) and 23(6) or side elements 21 and 22.

While the rungs 23(2) through 23(5) are saturated, when external circuitry (not shown) thereafter applies the INPUT signal to the input line 14, magnetic flux is generated in the laddic structure 20, specifically in rung 23(1), in response to the signal. The direction of flux in the rung 21(1) is determined by the direction of current of the INPUT signal. The flux is coupled through the side elements 21 and 22 past the saturated rungs to the rung 23(6) at the distal end of the laddic structure 20. If, for example, the current in the input line 14 is in the clockwise direction, flux will be generated in the rung 23(1) in an upward direction.

To complete the magnetic circuit, flux must also be generated in another rung 23(*k*), which has not been saturated, as well as the side elements 21 and 22 between that rung 23(*k*) and the rung 23(1). Since the first unsaturated rung after rung 23(1) is distal rung 23(6), the magnetic flux generated in response to the input signal on input line 14 travels along the side elements 21 and 22 to that rung 23(6). At that rung, the flux will have a downward direction, as shown in FIG. 3. Thus, flux resulting from the input signal will effectively have a clockwise direction in the laddic structure 20. If the current comprising the INPUT signal and the addressing signals applied to the P(i) and Q(i) addressing wires have the opposite direction, the flux resulting therefrom will also have the opposite direction.

Thus, the direction of the current comprising the INPUT signal applied to the laddic structure 20 when the rungs 23(2) through 23(5) are saturated by the addressing signals applied to row and column address lines P(i) and Q(j), in turn controls the direction of magnetic flux in the distal rung 23(6). It will also be appreciated that, since the magnetic circuit is completed, the direction of flux will remain constant until the magnetic circuit is changed, that is, until the INPUT signal is applied to the input rung 23(1) with a different direction while the rungs 23(2) through 23(5) are saturated by the addressing signals applied to row and column addressing lines P(i) and Q(j).

Returning to FIG. 2, the wire 15(*i*)(*j*) connecting the control module 11(*i*)(*j*) to the video element 13(*i*)(*j*) is, in turn, connected to one terminal of a coil 24 wound around the distal rung 23(6) of the laddic structure 20. The other terminal of the coil 24 is connected through an inductor 30 to the power source 29. As noted above, the wire 15(*i*)(*j*) interconnecting the control module 11(*i*)(*j*) and the video element 13(*i*)(*j*) is also connected to a capacitor 16(*i*)(*j*), which operates as a filter. The video element 13(*i*)(*j*), if it comprises in particular a liquid crystal, exhibits a capacitance represented by reference numeral 25(*i*)(*j*) and a leakage resistance represented by reference numeral 26(*i*)(*j*). Essentially, energization of the liquid crystal occurs by charging its capacitance 25(*i*)(*j*) in a selected direction, causing it to change its light-transmission properties. If the liquid crystal is not re-energized periodically, the leakage current through the leakage resistor 26(*i*)(*j*) will cause the charge stored in the capacitance 25(*i*)(*j*) to discharge, and thus the liquid crystal to de-energize. When that occurs, the liquid crystal deactivates, returning its light transmission properties to that of its de-activated state.

It will be appreciated that the two capacitances provided by filter capacitor 16(*i*)(*j*) and the capacitance 25(*i*)(*j*) of the liquid crystal, in parallel, exhibit an equivalent capacitance that equals the sum of their respective capacitance. In addition, the coil 24 and inductor 30 exhibit an equivalent inductance that is the sum of their individual inductances. A resonant circuit is formed from the filter capacitor 16(*i*)(*j*), the capacitance 25(*i*)(*j*) of the liquid crystal, the coil 24 and the inductor 30, whose resonant frequency is governed by the respective equivalent capacitance and equivalent inductance. The amount of current that can be coupled through the resonant circuit, and that effectively is available to charge the capacitance 25(*i*)(*j*) to energize the liquid crystal, is determined by the resonant frequency of the resonant circuit, the frequency of the signal output by the power source 29, and the "Q", or quality factor of the resonant circuit. The resonant circuit exhibits a resonant frequency determined by the equivalent capacitance of the circuit and the inductance of the coil 24, and the "Q" quality factor is determined by the values for the capacitance and the leakage resistance 26(*i*)(*j*).

Of these values, the value of the inductance exhibited by the coil 24(*i*)(*j*) can be varied by the addressing element 12(*i*)(*j*). In particular, the value of the inductance is determined by the physical structures of coil 24(*i*)(*j*) and the rung 23(6), as well as by the direction of the magnetic flux in the rung 23(6) in relation to the direction of current of the pulsed signal provided by the power source 29. It will be appreciated that the pulsed signal provided by the power source 29 enables generation of a magnetic flux by the coil 24(*i*)(*j*). If the generated flux is in the same direction as the flux in the rung 23(6) generated in response to the INPUT signal as applied to rung 23(1), the inductance is relatively low, resulting in a relatively high resonant frequency. In addition, the impedance through the coil 24(*i*)(*j*) to flow of current is relatively low. If the pulse signal generated by the power supply 29 has a corresponding resonant frequency, a relatively large amount of current is permitted to flow. It will be appreciated that the direction of current flow permitted by the low impedance through coil 24(*i*)(*j*), either to or from the capacitance 25(*i*)(*j*), will depend on the direction of flux in the rung 23(6).

On the other hand, if the flux generated in the rung 23(6) from the INPUT signal applied to rung 23(1) is in the opposite direction as the flux generated by coil 24(*i*)(*j*) in response to the signal from the power supply 29, the inductance of the coil 24(*i*)(*j*) to the signal is relatively high, resulting in a relatively low resonant frequency. In addition, the impedance through the coil 24(*i*)(*j*) to the flow of current is relatively high. Since the power supply 29 does not provide a signal at this frequency, very little current will flow through the coil 24(*i*)(*j*) in that situation.

Accordingly, the direction of current defining the INPUT signal, and thus the direction of flux in the rung 23(6) can control the direction of current flow to or from the capacitance 25(*i*)(*j*) of the video element 13(*i*)(*j*) through the coil 24(*i*)(*j*), which, in turn, controls the energization or de-energization of the video element 13(*i*)(*j*).

With this background, the operation of the arrangement 10 (FIG. 1) will be described. When the image provided by the video display controlled by the video display control arrangement 10 is to be refreshed, external control circuitry (not shown) establishes flux directions in the addressing elements 12(*i*)(*j*), and the respective video elements 13(*i*)(*j*) are energized or de-energized to provide the required image. The flux directions in the addressing elements 12(*i*)(*j*) of the control modules 11(*i*)(*j*) may be established in a number of ways. For example, external control circuitry (not shown) may establish the direction of current of the INPUT signal to be that to enable the video elements 13(*i*)(*j*) to be energized, and then the external control circuitry may, in a scanning manner, assert addressing signals on the row and column addressing wires P(i) and Q(j), respectively, enabling all of those addressing elements 12(*i*)(*j*) to be energized. Thereafter, the power supply 29 may generate a sinusoidal pulse signal having current in a direction to energize the video elements 13(*i*)(*j*) connected to the energized addressing elements 12(*i*)(*j*). After that, if necessary to de-energize previously-energized video elements 13(*i*)(*j*), the external control circuitry may establish the INPUT signal in the opposite direction, and then, in a scanning manner, assert addressing signals on the row and column addressing wires P(i) and Q(j) to enable all of the other addressing elements 12(*i*)(*j*) to be energized. The power supply 29 may then generate a sinusoidal pulse signal having a direction opposite to its previous direction, to de-energize the video elements 13(*i*)(*j*) connected to those addressing elements 12(*i*)(*j*).

Alternatively, the external control circuitry may enable a complete energization or de-energization operation to be performed on each control module 11(*i*)(*j*) before starting on the next. That is, the external control circuitry may, for each addressing element 12(*i*)(*j*), enable the appropriate addressing signals to be applied to the row and column addressing wires P(i) and Q(j) to identify the addressing element, and generate an INPUT signal having the required direction, to generate flux of the appropriate direction in the rung 23(6). Thereafter, the external control circuitry may enable the power supply 29 to generate a signal with current of the required direction to energize or de-energize the corresponding video element 13(*i*)(*j*). After completing these operations for each video element 13(*i*)(*j*), the external control circuitry may then step to the next video element 13(*i*)(*j*) until the states of all of the video elements 13(*i*)(*j*) have been established.

It will also be appreciated that, once the states of the addressing elements 12(*i*)(*j*) have been established, they will maintain their respective states until modified by the external control circuitry, which need not occur unless it is necessary to modify the image. To facilitate modification of the image maintained by the arrangement 10, the external control circuitry need only modify the states of the addressing elements 12(*i*)(*j*) and associated video control elements 13(*i*)(*j*) required to effect modification of the image.

Among the benefits of the invention is that it facilitates the production of large (such as twenty to forty inch) liquid crystal display screens at low cost. Because the device is magnetic, and can be manufactured using sputtering techniques at low temperature, many of the manufacturing problems associated with the complex control circuitry currently used are solved. The device uses high volume manufacturing methods which presently exist in American technology.

The foregoing description has been limited to a specific embodiment of this invention. It will be apparent, however, that variations and modifications may be made to the invention, with the attainment of some or all of the advantages of the invention. Therefore, it is the object of the appended claims to cover all such variations and modifications as come within the true spirit and scope of the invention.

What is claimed as new and desired to be secured by Letters Patent of the United States is:

1. A video display element comprising:

A. an electrically-chargeable video display control element for controlling display of a portion of an image, said element having a plurality of display conditions each associated with a charge condition;

B. a power source for generating electrical current;

C. a control portion for controlling the coupling of current from said power source to said video display control element, said control portion comprising:

i. a laddic-shaped addressing element having a pair of sidebars and plurality of rungs including an input rung, at least one addressing rung, and an enabling rung, the sidebars having a lower magnetic reluctance than the rungs;

ii. an input wire magnetically coupled to the input rung for generating an input flux signal in the addressing element, the input flux signal having a direction associated with the charge condition of the video display control element;

iii. an enabling wire magnetically coupled to the enabling rung, the power source and the video display control element for controlling the transfer of current from the power source to the video display control element to control the charge condition of the video display control element;

iv. an input addressing wire magnetically coupled to the addressing rung for selectively controlling coupling of the input flux signal at the input rung to the enabling rung for controlling coupling of current from said power source by the enabling wire.

2. A video display element as defined in claim 1 in which the input addressing element includes a plurality of input addressing rungs, the input addressing portion including a like plurality of input addressing wires each magnetically coupled to one of the input addressing rungs for selectively controlling coupling of the input flux signal at the input rung to the enabling rung.

3. A video display element as defined in claim 1 in which said enabling wire includes a coil magnetically coupled to said enabling rung, and capacitive means connected to said coil to establish a resonant circuit having a resonant frequency responsive to the direction of magnetic flux in said enabling rung and an impedance responsive to the direction of currnet of a charging signal from said power source, said power source providing said charging signal of selected frequency and current direction to selectively establish the charge condition of said video display control element.

4. A video display element as defined in claim 3 in which said video display control element includes said capacitive means.

5. A video display element comprising:

A. an electrically-chargeable video display control element for controlling display of a portion of an image, said element having a plurality of display conditions each associated with a charge condition;

B. a power source for generating electrical current;

C. an addressing portion comprising a magnetic input addressing element for receiving at an input magnetic flux representing a selected charge condition for said video display control element and selectively coupling the flux to an output to control application of the current generated by said power source to control the charge condition of said video display control element.

6. A video display element as defined in claim 5 wherein the address portion comprises:

A. a laddic-shaped addressing element having a pair of sidebars and plurality of rungs including an input rung, at least one addressing rung, and an enabling rung, the sidebars having a lower magnetic reluctance than the rungs;

B. an input wire magnetically coupled to the input rung for generating an input flux signal in the addressing element, the input flux signal having a direction associated with the charge condition of the video display control element;

C. an enabling wire magnetically coupled to the enabling rung, the power source and the video display control element for controlling the transfer of current from the power source to the video display control element to control the charge condition of the video display control element;

D. an input addressing wire magnetically coupled to the addressing rung for selectively controlling coupling of the input flux signal at the input rung to the enabling rung for controlling coupling of current from said power source by the enabling wire.

7. A video display element as defined in claim 6 in which the input addressing element includes a plurality of input addressing rungs, the input addressing portion including a like plurality of input addressing wires each magnetically coupled to one of the input addressing rungs for selectively controlling coupling of the input flux signal at the input rung to the enabling rung.

8. A video display element as defined in claim 7 in which said enabling wire includes a coil magnetically coupled to said enabling rung, and capacitive means connected to said coil to establish a resonant circuit having a resonant frequency responsive to the direction of magnetic flux in said enabling rung and an impedance responsive to the direction of current of a charging signal from said power source, said power source providing said charging signal of selected frequency and current direction to selectively control the charge condition of said video display control element.

9. A video display element as defined in claim 8 in which said video display control element includes said capacitive means.

10. A video display system comprising:

A. a plurality of electrically-chargeable video display control elements each for controlling display of a portion of an image, each element having a plurality of conditions each associated with a charge condition;

B. a power source for generating electrical current;

C. a plurality of control portions, each associated with one of said video display control elements for controlling the coupling of current from said power source to the associated video display control element, each control portion comprising:

i. a laddic-shaped addressing element having a pair of sidebars and plurality of rungs including an input rung, at least one addressing rung, and an enabling rung, the sidebars having a lower magnetic reluctance than the rungs;

ii. an input wire magnetically coupled to the input rung for generating an input flux signal in the addressing element, the input flux signal having a direction associated with the charge condition of the video display control element;

iii. an enabling wire magnetically coupled to the enabling rung, the current source and the associated video display control element for controlling the transfer of current from the power source to the video display control element to control the charge condition of the associated video display control element;

iv. an input addressing wire magnetically coupled to the addressing rung for selectively controlling coupling of the input flux signal at the input rung to the enabling rung for controlling coupling of current from said power source by the enabling wire.

11. A video display system as defined in claim 10 in which the input addressing element includes a plurality of input addressing rungs, the input addressing portion including a like plurality of input addressing wires each magnetically coupled to one of the input addressing rungs for selectively controlling coupling of the input flux signal at the input rung to the enabling rung.

12. A video display system as defined in claim 10 in which said enabling wire includes a coil magnetically coupled to said enabling rung, and capacitive means connected to said coil to establish a resonant circuit having a resonant frequency responsive to the direction of magnetic flux in said enabling rung and an impedance responsive to the direction of current of a charging signal from said power source, said power source providing said charging signal of selected frequency and current direction to selectively establish the charge condition said video display control element.

13. A video display element as defined in claim 12 in which said video display control element includes said capacitive means.

* * * * *